United States Patent [19]

Tutzschky et al.

[11] 3,964,733

[45] June 22, 1976

[54] MIXER FOR MOLDING SAND

[75] Inventors: Rudolf Tutzschky; Fritz Lenzinger, both of Karlsruhe, Germany

[73] Assignee: Badische Maschinenfabrik GmbH, Germany

[22] Filed: Apr. 15, 1974

[21] Appl. No.: 460,998

[30] Foreign Application Priority Data

Apr. 13, 1973 Germany ..... 2318692

[52] U.S. Cl. ..... 259/103; 259/41

[51] Int. Cl.[2] ..... B01F 7/00; B01F 7/04

[58] Field of Search ..... 259/5, 6, 21, 40, 41, 259/64, 102, 103, 178 A; 220/63 R

[56] References Cited

UNITED STATES PATENTS

| | | | |
|---|---|---|---|
| 1,468,967 | 9/1923 | Hottmann | 259/6 X |
| 2,687,230 | 8/1954 | McPherson | 220/63 R |
| 3,071,352 | 1/1963 | McIntyre | 259/6 X |
| 3,104,225 | 9/1963 | Benedetto | 220/63 R X |
| 3,134,576 | 5/1964 | Lödige et al. | 259/21 |
| 3,228,664 | 1/1966 | McMillan | 259/178 A |
| 3,482,823 | 12/1969 | Rechtin | 259/102 |
| 3,770,251 | 11/1973 | Herfeld | 259/103 |

FOREIGN PATENTS OR APPLICATIONS

| | | | |
|---|---|---|---|
| 1,201,308 | 9/1965 | Germany | 259/102 |

*Primary Examiner*—Billy J. Wilhite
*Assistant Examiner*—James A. Niegowski
*Attorney, Agent, or Firm*—Craig & Antonelli

[57] ABSTRACT

Mixer for molding sand and the like having a stationary smooth mixer bowl with a central tool located at the bottom thereof for imparting rotational movement to the sand being mixed in the bowl. Extending downwardly from above into the sand being mixed are a plurality of centrifugal tools located eccentrically with respect to the axis of the bowl. These centrifugal tools are rotated in a direction opposite the direction of rotation of the central tool. The radially extending vanes of the central tool are configured with respect to the plurality of centrifugal tools such that only one vane is in simultaneous facing relationship to any of the centrifugal tools during mixing operations. The centrifugal tools are rotated about axes extending obliquely with respect to the axis of rotation of the central tool so that the spacing of the centrifugal tools from the axis of the central tool is larger at the top than at the bottom. Each of the centrifugal tools is disposed at a stationary position with respect to the bowl.

29 Claims, 2 Drawing Figures

Fig. 1
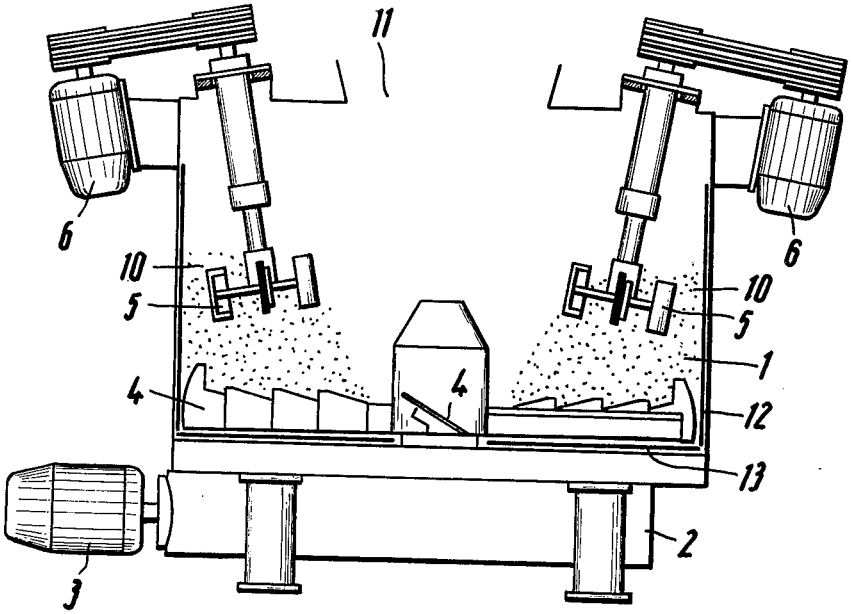
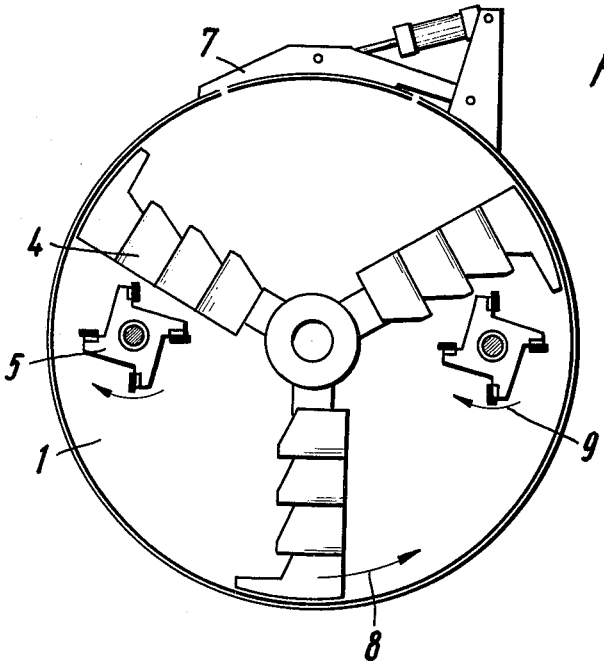
Fig. 2

MIXER FOR MOLDING SAND

BACKGROUND AND SUMMARY OF THE INVENTION

This invention relates to mixing machines for foundry mold sand and the like with increased efficiency and yet a simple and rugged construction.

The desire to expose all of the sand in a mixing vessel maximally frequently and uniformly to the mixing tools has resulted in two types of structure for container mixers. In one type of structure, the container is stationary and eccentric mixing tools move along paths about the container axis of the mixer during mixing operations. In the other type of structure, the mixing container rotates and the eccentric mixing tools or their respective shafts, if driven, are stationary. Theoretically, in the first type of arrangement, the sand is at a standstill with respect to the container and the eccentric mixing tools are moved by the stationary sand; and in the second type of structure, the shaft of the rotating eccentric tool is stationary and the sand is entrained by the rotating bowl and moved toward the eccentric tools. Therefore, in these mixers, an important feature is that the sand does not execute a relative motion with respect to the bowl. Thus, the sand is supposed to be also at a standstill, with the bowl being stationary, and to participate in the rotation, if the bowl is rotating. In order to enhance this behavior, vertical ribs have in many cases been provided along the periphery of the bowl, in order to brake the sand, or the bowl circumference has been equipped with a high friction by an appropriate selection of the material, for example by lining the bowl with rubber. In conventional mold sand mixers with eccentrically disposed tools, it has furthermore been necessary to provide, in addition to the drive for rotating the eccentrically disposed tools about their own axis, a further drive means, either for the movement of the shafts of the eccentrically disposed tools about the bowl axis or for the rotation of the bowl, whereby these machines become complicated and expensive in manufacture and upkeep. Furthermore, at higher speeds of rotation, difficulties are encountered in the central discharging of rotating mixing containers due to centrifugal effects. Also, when the container is at a standstill and the mixing tools rotate in a planetary motion, the drive is effected from above, whereby the introduction of the sand is impeded.

The present invention contemplates providing a mixer which avoids the above-discussed disadvantages and, with a simple construction and correspondingly low manufacturing costs, shows a high mixing efficiency. More particularly, the present invention contemplates providing a mixer having a stationary mixing bowl having a rotating central tool disposed at the bottom thereof for imparting rotational movement to molding sand or the like being mixed. At least one driven centrifugal tool which is spaced from the axis of the bowl extends downwardly into the bowl from above facing spaced relationship to the central tool for imparting further mixing motion to the material in the bowl. According to the invention, each of the centrifugal tools are disposed at fixed positions around the periphery of the staionary bowl, thereby obviating the need for mechanisms to rotate either the bowl or the centrifugal tools about the bowl axis. In preferred embodiments according to the invention, the rotating central tool imparts maximal rapid rotation to the contents of the container.

According to a further feature of the invention, the bowl is provided with a smooth inner surface made of a material with low friction so as to not retard the rotational motion of the bowl contents. In particularly preferred arrangement of the present invention, the inner surface of the bowl, along the walls and the bottom, is provided with a lining of hard-chromeplated steel sheet.

According to another feature of a preferred embodiment of the present invention, the central tool is provided with a plurality of agitator vanes extending radially from a central hub portion to immediately adjacent the vertical wall of the bowl. A plurality of centrifugal tools are also provided which are arranged spaced from one another and from the bowl axis which coincides with the rotational axis of the central tool. The centrifugal tools and the agitator vane are provided at positions with respect to one another such that only a single centrifugal tool faces any of the vanes at any given time. That is, at any given time during operation of the mixer with the central tool rotating such that the vanes sequentially pass under the centrifugal tools, only a single centrifugal tool is directly vertically above a vane moving thereunder at any given time, with all other centrifugal tools being vertically above a space intermediate the vanes at said given time.

According to another feature of the invention, the centrifugal tools are rotated oppositely to the direction of rotation of the agitator vanes of the central tool. Another feature of a preferred embodiment of the invention is that the axes of the centrifugal tools deviate from the vertical so that their spacing from the central axis of the bowl (also rotational axis of the central tool) is larger at the top than at the bottom. The centrifugal tools are configured and spaced with respect to the bowl so as to engage the top layer of sand during mixing operations. Another feature of a preferred embodiment of the invention is in the inclusion of a plurality of obliquely oriented, exchangeable vane plates on each of the agitator vanes, which vane plates are spaced from one another along the length of the vanes from the shell or wall of the mixing bowl to the central drive hub.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 is a schematic lateral sectional view of a mixer constructed in accordance with the present invention; and FIG. 2 is a top schematic view of the mixer of FIG. 1.

DETAILED DESCRIPTION OF THE DRAWINGS

FIGS. 1 and 2 show the mixing container 1 with a drive system 2 and a drive engine 3 for the central agitator vanes 4 being arranged underneath the container. The centrifugal tools 5 are driven individually by motors 6. The directions of rotation 9 (see FIG. 2) of the centrifugal tools 5 are in opposition to the direction of rotation 8 of the agitator vanes.

The level or height position of the centrifugal tools 5 in the container 1 is selected so that they contact the upper layer of sand 10, as formed during operation of the mixer.

A sealable flap 7 is provided on the outer periphery of the container for accommodating discharge of the contents thereof, while an opening 11 is provided for filling the container.

A lining 12 formed substantially with hard-chrome-plated smooth surfaces is provided at the bowl shell or vertical walls, and the bottom plates 13 are constructed of similar hard-chromeplated material.

The disposition of the centrifugal tools at positions spaced from the central hub and fixed along the periphery of the bowl facilitates the provision of the large free feed opening 11. The disposition of the discharge opening 7 at the lateral side of the bowl or container makes it possible to advantageously utilize the centrifugal force imparted by the central tool vanes 4 for discharging the contents of the bowl. The elimination of the drives for the rotation of the bowl or for a planetary movement of the centrifugal tools renders the manufacture and upkeep very economical. Also, the possibility of simultaneously employing a high speed for the tools and a large amount of material filled into the mixer permits processing of large amounts of sand with the apparatus of the present invention.

The details of the driving connections for the mixers have not been included, since known driving mechanisms, mainly electric motors and the like for rotating drive shafts, can be readily used.

The following dimensional example is given to facilitate an understanding of the present invention and the practice thereof by others, and is not intended to limit the scope of the claims. The centrifugal tools are preferably positioned with their axis of rotation extending in the range of 7° to 10° with respect to the vertical. The agitator vanes 4 are inclined approximately 30° with respect to the horizontal. While the central tool preferably rotates in the range of 45 to 55 rpm, with a consequent tip speed of between 6.8 and 8.2 meters per second (assuming a diameter of 2.85 meters for the bowl and slightly less for the central tool), the centrifugal tools are preferably rotated in the range of between 1000 and 1200 rpm wth a tip speed of between 23 to 29 meters per second (assuming the diameter of the centrifugal tool can be in the range between 450 and 470 mm). The top of the outer portion of the central tool is spaced approximately 290 mm from the horizontal floor, while the tips of the individual vanes 4 are spaced approximately 170 mm from the floor. The bottom portion of the centrifugal tools is spaced approximately 420 mm from the horizontal floor of the bowl such that, during operation, the centrifugal tool is immersed in the material being mixed over most of the travel path of the rotating centrifugal tool. For example, the material in the mixing container will extend approximately a total of 800 mm from the horizontal floor of the bowl at the outer edge to a minimum practically zero height at the central portion of the container. Although the above-noted specific dimensional ranges form part of a preferred embodiment of the invention, such dimensions are not intended to limit the scope of the claims. For example, with changes in the diameter of the basic mixing container, corresponding changes in the dimensions of the remaining structure will also take place.

While we have shown and described one embodiment in accordance with the present invention, it is understood that the same is not limited thereto but is susceptible of numerous changes and modifications as known to those skilled in the art and we therefore do not wish to be limited to the details shown and described herein but intended to cover all such changes and modifications as are encompassed by the scope of the appended claims.

We claim:

1. Mixer for molding sand and the like comprising:

a stationary mixer bowl having a central bowl axis, a central tool for imparting rotational movement to the contents of the bowl with respect to the bowl axis, central tool drive means for driving said central tool rotatably about said bowl axis, at least one centrifugal tool disposed eccentrically to the bowl axis for imparting mixing effect to said contents as said contents are rotated by said central tool, centrifugal tool drive means for rotatably driving each of said at least one centrifugal tools, and centrifugal tool support means for supporting each of said at least one centrifugal tools at a fixed position with respect to said bowl and such that each of said at least one centrifugal tools is in facing spaced relationship with respect to the central tool plane within which said central tool rotates, wherein each of said at least one centrifugal tools is positioned with its axis of rotation inclined such that rotational movement of said centrifugal tool imparts a greater material movement velocity component in directions parallel to the central tool plane than in directions perpendicular to the central tool plane, whereby said at least one centrifugal tool effects rapid mixing movement of said contents including substantial movement of said contents in directions away from those side wall portions of said mixer bowl which are closest to the respective centrifugal tool.

2. Mixer according to claim 1, wherein said central tool is disposed at the bottom of said bowl, and wherein each of said at least one centrifugal tools dip downwardly into said bowl from above said central tool.

3. Mixer according to claim 2, wherein the bowl is provided with an inner low friction surface at least in the area adjacent the path of movement of said central tool so that rotational movement of said contents is unimpeded by the inner surfaces of said bowl.

4. Mixer according to claim 3, wherein said bowl is cylindrical in shape.

5. Mixer according to claim 3, wherein said bowl is provided with a hard-chromeplated lining.

6. Mixer according to claim 5, wherein said lining is a hard-chromeplated steel sheet.

7. Mixer according to claim 3, wherein said low friction surface is formed by a lining constructed of one of stainless steel and synthetic resinous polyethylene material.

8. Mixer according to claim 2, wherein said central tool includes a plurality of agitator vanes extending radially laterally outwardly of a centrally disposed hub means, wherein a plurality of said centrifugal tools are provided at positions around the periphery of said bowl such that they face the vanes at parts of said vanes intermediate the hub means and the outer radial extent of said vanes, and wherein said vanes and centrifugal tools are configured and disposed such that when a centrifugal tool is directly vertically above a vane moving thereunder, all other centrifugal tools are vertically above a space intermediate the vanes.

9. Mixer according to claim 8, wherein said bowl is cylindrical and the vanes of said central tool extend radially to immediately adjacent the vertical walls of said bowls, wherein three vanes are provided symmetrically about said bowl axis, and wherein two centrifugal tools are provided at opposite sides of said bowl axis.

10. Mixer according to claim 7, wherein each of said at least one centrifugal tools rotates in a direction opposite to the direction of rotation of said central tool.

11. Mixer according to claim 10, wherein the axes of rotation of each of said at least one centrifugal tools is inclined to the vertical so that their spacing from the bowl axis is larger at the top than at the bottom.

12. Mixer according to claim 11, wherein each of said at least one centrifugal tools is disposed to directly engage the upper layer of the contents of said bowl during operation of the mixer.

13. Mixer according to claim 8, wherein the axes of rotation of each of said at least one centrifugal tools is inclined to the vertical so that their spacing from the bowl axis is larger at the top than at the bottom.

14. Mixer according to claim 8, wherein each of said at least one centrifugal tools is disposed to directly engage the upper layer of the contents of said bowl during operation of the mixer.

15. Mixer according to claim 8, wherein each of said agitator vanes includes a plurality of exchangeable vane plates, said vane plates being spaced from another along the length of said vanes at positions from said hub means to the outer end adjacent vertical walls of said bowl, said vane plates extending at an angle with respect to the plane of the bottom of the bowl.

16. Mixer according to claim 15, wherein each of said at least one centrifugal tools rotates in a direction opposite to the direction of rotation of said central tool.

17. Mixer according to claim 15, wherein said bowl is cylindrical and the vanes of said central tool extend radially to immediately adjacent the vertical walls of said bowls, wherein three vanes are provided symmetrically about said bowl axis, and wherein two centrifugal tools are provided at opposite sides of said bowl axis.

18. Mixer according to claim 15, wherein the axes of rotation of each of said at least one centrifugal tools is inclined to the vertical so that their spacing from the bowl axis is larger at the top than at the bottom.

19. Mixer according to claim 15, wherein each of said at least one centrifugal tools is disposed to directly engage the upper layer of the contents of said bowl during operation of the mixer.

20. Mixer according to claim 2, wherein each of said at least one centrifugal tools rotates in a direction opposite to the direction of rotation of said central tool.

21. Mixer according to claim 20, wherein the axes of rotation of each of said at least one centrifugal tools is inclined to the vertical so that their spacing from the bowl axis is larger at the top than at the bottom.

22. Mixer according to claim 2, wherein the axes of rotation of each of said at least one centrifugal tools is inclined to the vertical so that their spacing from the bowl axis is larger at the top than at the bottom.

23. Mixer according to claim 22, wherein each of said at least one centrifugal tools is disposed to directly engage the upper layer of the contents of said bowl during operation of the mixer.

24. Mixer according to claim 2, wherein each of said at least one centrifugal tools is disposed to directly engage the upper layer of the contents of said bowl during operation of the mixer.

25. Mixer according to claim 1, wherein said central tool drive means includes means for driving said central tool at a rotational speed in the range of 45 to 55 revolutions per minute, and wherein said centrifugal tool drive means includes means for driving each of said at least one centrifugal tools at a rotational speed in the range of 1000 to 1200 revolutions per minute.

26. Mixer according to claim 1, wherein each of said centrifugal tools are positioned with their axis of rotation inclined in the range of 7° to 10° with respect to the vertical.

27. Mixer according to claim 25, wherein each of said centrifugal tools are positioned with their axis of rotation inclined in the range of 7° to 10° with respect to the vertical.

28. Mixer for molding sand and the like comprising:

a stationary mixer bowl having a central bowl axis, a central tool for imparting rotational movement to the contents of the bowl with respect to the bowl axis, central tool drive means for driving said central tool rotatably about said bowl axis, at least one centrifugal tool disposed eccentrically to the bowl axis for imparting mixing effect to said contents as said contents are rotated by said central tool, said at least one centrifugal tool being oriented and configured for effecting rapid mixing movement of said contents including movement of said contents in directions away from those side wall portions of said mixer bowl which are closest to the respective centrifugal tool, centrifugal tool drive means for rotatably driving each of said at least one centrifugal tools, and centrifugal tool support means for supporting each of said at least one centrifugal tools at a fixed position with respect to said bowl and such that each of said at least one centrifugal tool is in facing spaced relationship with respect to the plane within which said central tool rotates, wherein said central tool includes a plurality of agitator vanes extending radially laterally outwardly of a centrally disposed hub means, wherein a plurality of said centrifugal tools are provided at positions around the periphery of said bowl such that they face the vanes at parts of said vanes intermediate the hub means and the outer radial extent of said vanes, and wherein said vanes and centrifugal tools are configured and disposed such that when a centrifugal tool is directly vertically above a vane moving thereunder, all other centrifugal tools are vertically above a space intermediate the vanes.

29. Mixer according to claim 28, wherein said bowl is cylindrical and the vanes of said central tool extend radially to immediately adjacent the vertical walls of said bowls, wherein three vanes are provided symmetrically about said bowl axis, and wherein two centrifugal tools are provided at opposite sides of said bowl axis.

* * * * *